US006735789B2

(12) United States Patent
Kelleher et al.

(10) Patent No.: US 6,735,789 B2
(45) Date of Patent: May 18, 2004

(54) REFLECTIVE PRINTING ON FLAME RESISTANT FABRICS

(75) Inventors: Karen A. Kelleher, Mabelton, GA (US); Michael T. Stanhope, Atlanta, GA (US)

(73) Assignee: Southern Mills, Inc., Union City, GA (US)

( * ) Notice: Subject to any disclaimer, the term of this patent is extended or adjusted under 35 U.S.C. 154(b) by 0 days.

(21) Appl. No.: 09/919,214

(22) Filed: Jul. 31, 2001

(65) Prior Publication Data

US 2002/0016985 A1 Feb. 14, 2002

Related U.S. Application Data

(60) Provisional application No. 60/221,746, filed on Jul. 31, 2000.

(51) Int. Cl.[7] ..... A62B 17/00; A62D 5/00

(52) U.S. Cl. ..... 2/458; 2/87; 2/81; 2/93; 2/97; 428/325; 428/266

(58) Field of Search ..... 2/458, 87, 81, 2/93, 97; 428/325, 266, 143

(56) References Cited

U.S. PATENT DOCUMENTS

| | | | | | |
|---|---|---|---|---|---|
| 1,175,224 | A | | 3/1916 | Bleecker | 65/21.3 |
| 2,461,011 | A | | 2/1949 | Taylor et al. | 65/21.3 |
| 2,726,161 | A | | 12/1955 | Beck et al. | 501/34 |
| 2,842,446 | A | | 7/1958 | Beck et al. | 501/75 |
| 2,853,393 | A | | 9/1958 | Beck et al. | 501/34 |
| 2,870,030 | A | | 1/1959 | Stradley et al. | 501/33 |
| 2,939,797 | A | | 6/1960 | Rindone | 501/34 |
| 2,965,921 | A | | 12/1960 | Bland | 65/21.2 |
| 2,992,122 | A | | 7/1961 | Beck et al. | 501/33 |
| 3,468,681 | A | | 9/1969 | Jaupain | 106/47 |
| 3,946,130 | A | | 3/1976 | Tung et al. | 428/325 |
| 4,192,576 | A | | 3/1980 | Tung et al. | 350/105 |
| 4,336,092 | A | * | 6/1982 | Wasserman | 156/269 |
| 4,367,919 | A | | 1/1983 | Tung et al. | 350/105 |
| 4,533,592 | A | * | 8/1985 | Bingham | 428/213 |
| 4,546,042 | A | * | 10/1985 | Quon | 428/378 |
| 4,564,556 | A | | 1/1986 | Lange | 428/325 |
| 4,758,469 | A | | 7/1988 | Lange | 428/325 |
| 4,763,985 | A | | 8/1988 | Bingham | 350/105 |
| 4,772,511 | A | | 9/1988 | Wood et al. | 428/325 |
| 4,817,210 | A | * | 4/1989 | Aldridge et al. | 2/246 |
| 4,931,414 | A | | 6/1990 | Wood et al. | 501/103 |

(List continued on next page.)

OTHER PUBLICATIONS

Standard Practice for Measuring Photometric Characteristics of Retroreflectors; American Society for Testing and Materials; pp. 1–10.

Have you seen the light? BTTG Fire Technology Services; pp. 1–17.

*Primary Examiner*—John J. Calvert
*Assistant Examiner*—Robert H. Muromoto, Jr.
(74) *Attorney, Agent, or Firm*—Thomas, Kayden, Horstemeyer & Risley

(57) ABSTRACT

A retroreflective garment constructed of flame resistant fabric. The garment is light-weight and can be single or double layered. Garments that can be constructed of flame resistant fabric with retroreflective elements applied thereon include garments such as, for example, shirts, pants, coveralls, jumpsuits, jackets, gloves, hats, etc. The flame resistant fabric has a coefficient of retroreflection of about 10 to about 500 candelas per lux per square meter. In addition, the retroreflective elements cover at least about 5 percent of the outer surface of the flame resistant fabric.

65 Claims, 3 Drawing Sheets

U.S. PATENT DOCUMENTS 5,128,804 A 7/1992 Lightle et al. ..... 359/515
5,200,262 A 4/1993 Li ..... 428/266
5,207,852 A * 5/1993 Lightle et al. ..... 156/230
5,269,840 A * 12/1993 Morris et al. ..... 106/437
5,650,213 A 7/1997 Rizika et al. ..... 428/143
5,835,271 A * 11/1998 Stump et al. ..... 359/529
5,900,978 A * 5/1999 Sagar et al. ..... 359/536
6,009,560 A * 1/2000 McKenney et al. ..... 2/244
6,110,558 A 8/2000 Billingsley et al. ..... 428/67
6,153,128 A 11/2000 Lightle et al. ..... 264/1.9
6,159,878 A * 12/2000 Marsh ..... 156/67
6,238,772 B1 * 5/2001 Paul et al. ..... 428/101
6,243,201 B1 6/2001 Fleming et al. ..... 359/530
6,245,700 B1 6/2001 Budd et al. ..... 501/34

* cited by examiner

REFLECTIVE PRINTING ON FLAME RESISTANT FABRICS

CROSS-REFERENCE TO RELATED APPLICATION

This application claims priority to U.S. provisional application entitled, "Reflective Printing on Fire Retardant Fabrics," having Ser. No. 60/221,746, filed Jul. 31, 2000, which is entirely incorporated herein by reference.

TECHNICAL FIELD

The present invention is generally related to retroreflective garments and, more particularly, is related to garments that are constructed of retroreflective fabrics.

BACKGROUND OF THE INVENTION

Retroreflectivity is a characteristic in which obliquely incident light is reflected in the same direction to the incident direction such that an observer at or near the light source receives the reflected light. This unique characteristic has led to the wide-spread use of retroreflective materials on various substrates because substrates coated with retroreflective materials are more easily identified during nighttime conditions. For example, retroreflective articles can be used on flat inflexible substrates, such as road signs and barricades; on irregular surfaces, such as corrugated metal truck trailers, license plates, and traffic barriers; and on flexible substrates, such as road construction personnel safety vests, running shoes, roll-up signs, and canvas-sided trucks.

There are two major types of retroreflective materials: beaded materials and cube-corner materials. Beaded materials commonly use a multitude of glass or ceramic microspheres partially coated with a specular reflective coating to retroreflect incident light. Typically, the microspheres are partially embedded in a support film, where the specular reflective coating is adjacent the support film. The reflective coating can be a metal coating such as, for example, an aluminum coating, or an inorganic dielectric mirror made up of multiple layers of inorganic materials that have different refractive indices.

In lieu of microspheres, cube-corner articles typically employ a multitude of cube-corner elements to retroreflect incident light. The cube-corner elements project from the back surface of a body layer. In this configuration, incident light enters the sheet at a front surface, passes through the body layer to be internally reflected by the faces of the cube-corner elements, and subsequently exits the front surface to be returned towards the light source. Reflection at the cube-corner faces can occur by total internal reflection when the cube-corner elements are encased in a lower refractive index media (e.g. air) or by reflection off a specular reflective coating such as a vapor deposited aluminum film.

Retroreflective articles typically include a layer of retroreflective optical elements, microspheres, and/or cube-cornered elements, coated with a specular reflective coating. Generally, the retroreflective elements are embedded in a binder layer attached to the article. Typically, the optical elements are transparent microspheres that are partially embedded in the binder layer such that a substantial portion of each microsphere protrudes from the binder layer. The specular reflective coating is disposed on the portion of the transparent microsphere, which is embedded in the binder layer. Light striking the front surface of the retroreflective articles passes through the transparent microspheres, is reflected by the specular reflective coating, and is collimated by the transparent microspheres to travel back in a direction parallel to the incident light.

As discussed above, the use of retroreflective articles is widespread. For example, road construction personnel, utility personnel, and firefighter personnel often wear retroreflective clothing to make the wearer conspicuously visible at nighttime. The retroreflective articles displayed on this clothing typically comprises retroreflective stripes. Unfortunately, retroreflective stripes can have several significant drawbacks. For example, clothing provided with retroreflective stripes only reflects light from the stripe. Consequently, the person observing the reflected light may not be able to differentiate the reflecting stripes as representing a person, sign, or other obstacle. Further, if the person wearing the reflective stripe is positioned such that the stripe is blocked from the light, then the reflective stripe is ineffective. An additional disadvantage is that excessive layers of retroreflective material can make the garments heavier, less flexible, and can increase product cost.

Thus, a heretofore unaddressed need exists in the industry to provide garments that address the aforementioned deficiencies and inadequacies.

SUMMARY OF THE INVENTION

Embodiments of the present invention provide for a retroreflective garment constructed of flame resistant fabric. The garment is light-weight and single or double layered. Garments that can be constructed of flame resistant fabric with a plurality of retroreflective elements directly applied thereon include garments such as, for example, shirts, pants, coveralls, jumpsuits, jackets, gloves, hats, etc. The flame resistant fabric has a coefficient of retroreflection of about 10 to about 500 candelas per lux per square meter. In addition, the plurality of retroreflective elements covers at least about 5 percent of the outer surface of the flame resistant fabric. The flame resistant fabric is composed of flame resistant fibers such as, for example, aramid fibers, polybenzimidazole fibers, polybenzoxazole fibers, melamine fibers, flame resistant rayon, flame resistant cotton, or blends thereof.

Another embodiment provides for a method of constructing a retroreflective garment that is light-weight and is either single or double layered. The method includes applying the outer surface of the flame resistant fabric with a plurality of retroreflective elements and constructing a light-weight, retroreflective garment from the flame resistant fabric so that the outer surface that has the plurality of retroreflective elements applied thereon faces away from the body of the wearer. The plurality of retroreflective elements can be applied to the flame resistant fabric by process techniques such as, for example, flat screen printing techniques, rotary screen printing techniques, and retroreflective transfer film techniques.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

Moreover, in the drawings, like reference numerals designate corresponding parts throughout the several views.

DETAILED DESCRIPTION

Embodiments of the present invention include garments constructed of flame resistant fabrics that have had a plurality of retroreflective elements applied thereon, and therefore, have retroreflective characteristics. To overcome at least some of the deficiencies discussed above, a sufficient quantity of retroreflective elements are applied to the flame resistant fabric such that the entire garment, or at least a substantial portion thereof, is capable of retroreflecting incident light. Therefore, an observer near the incident light source will see an illuminated silhouette of a person wearing the garment, thereby enabling a driver of a vehicle to easily identify the silhouette as a person, rather than as an object. In contrast, if the wearer was wearing garments outfitted only with retroreflective stripes, then the driver may not identify the illuminated stripe as a person and drive with less care than if they saw an illuminated human silhouette. Thus, garments made with flame resistant fabric with a plurality of retroreflective elements applied thereon are advantageous in that they enable a person to be identified upon illumination with incident light, while also providing fire protection.

Garments that can be constructed of flame resistant fabric with retroreflective elements applied to the fabric include garments such as, for example, shirts, pants, coveralls, jumpsuits, jackets, gloves, hats, etc. Such retroreflective garments can be used by personnel, such as road construction personnel, EMS personnel, police personnel, military personnel, utility personnel, chemical plant personnel, and other personnel needing flame resistant garments that are retroreflective.

Figure 1A:
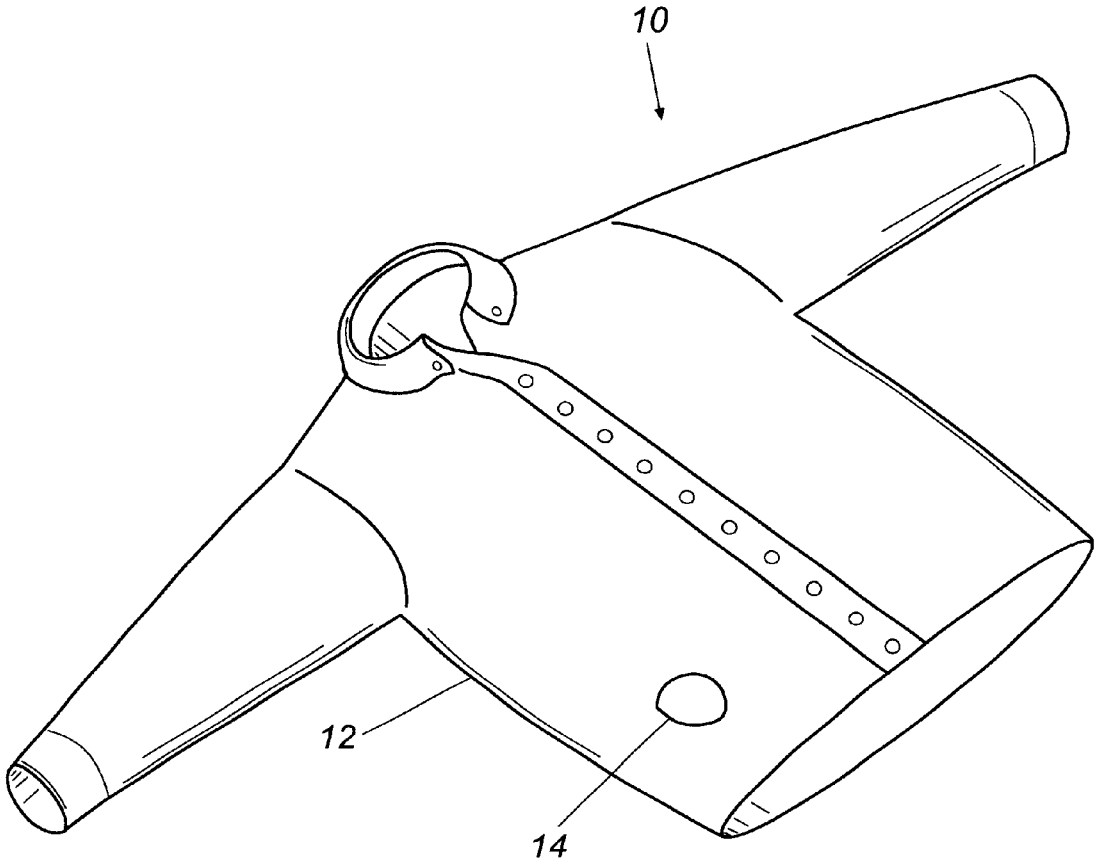
FIG. 1A is a perspective view of a flame resistant garment.

FIG. 1A illustrates a demonstrative example of a retroreflective, flame resistant garment 10, a shirt. The garment 10 is constructed of flame resistant fabric 12. The flame resistant fabric 12 is composed of flame resistant fibers such as, for example, aramid fibers, polybenzimidazole fibers, polybenzoxazole fibers, melamine fibers, flame resistant rayon, flame resistant cotton, or blends thereof. Aramid fibers include meta-aramid and para-aramid fibers. Prior to constructing the garment 10, the surface of the flame resistant fabric 12 has retroreflective elements applied thereon. The garment 10 is constructed such that the retroreflective surface faces away from the body so that incident light can be retroreflected back to the light source. The processes for applying the retroreflective elements will be discussed in more detail below. All, or substantially all, of the flame resistant fabric 12 used to construct the garment 10 is capable of having retroreflective characteristics. Other garments that have multiple layers, such as jackets, typically only need to have retroreflective flame resistant fabric as the outer layer so that incident light can be retroreflected.

One way in which to measure the intensity of retroreflection of a garment 10 is to determine the coefficient of retroreflection of fabric of the garment 10. The coefficient of retroreflection is the ratio of the coefficient of luminous intensity of a plane retroreflecting surface to its area, as expressed in candelas per lux per square meter. Garments 10 of the present invention include flame resistant fabric characterized by a coefficient of retroreflection that is in the range of about 10 to about 500 candelas per lux per square meter. More particularly, the coefficient of retroreflection range is about 100 to about 300 candelas per lux per square meter, with about 150 to about 250 candelas per lux per square meter being preferred.

Figures 1B, 1C:
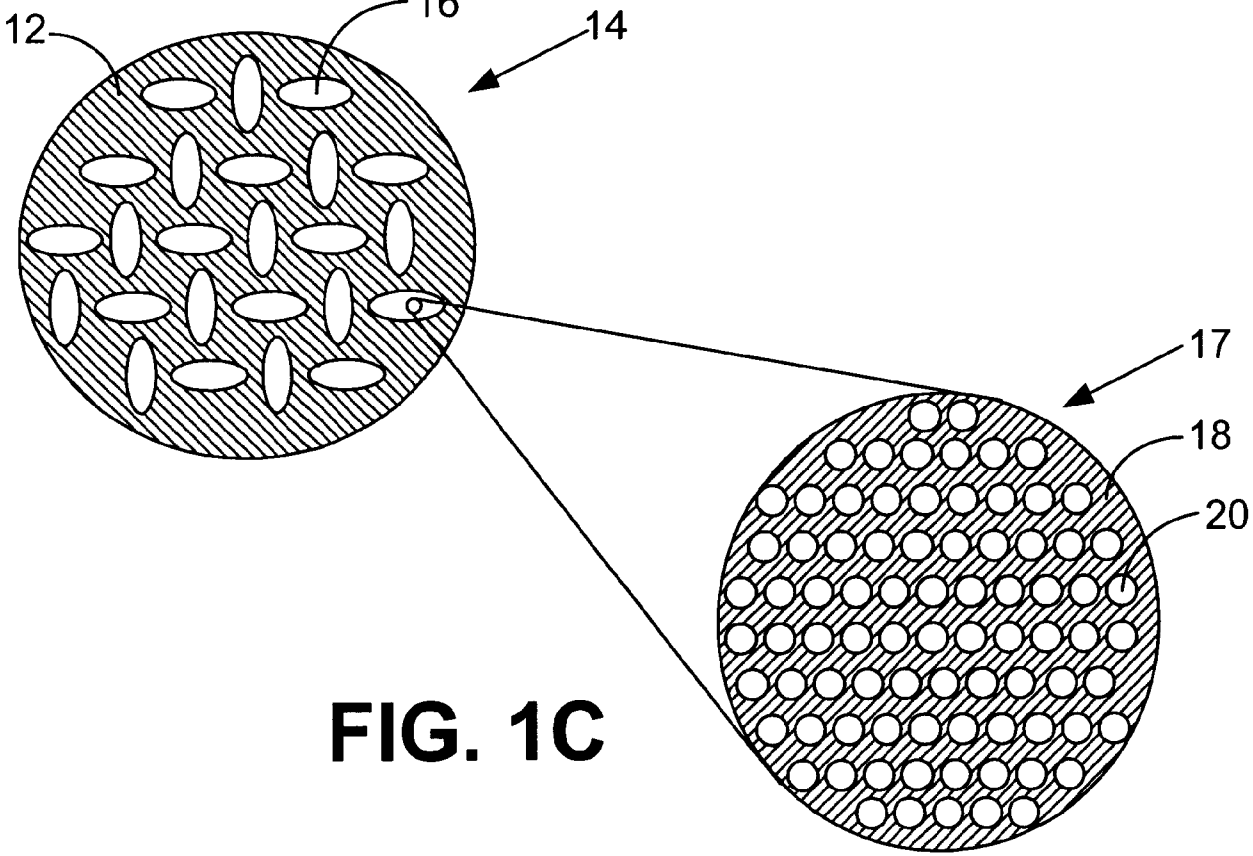
FIG. 1B is an exploded top-view of a part of the garment illustrated in FIG. 1A.
FIG. 1C is an exploded top-view of a portion of the plurality of retroreflective elements shown in FIG. 1B.

FIG. 1B is an exploded top-view of a cut-out portion 14 of the flame resistant fabric 12 of the garment 10 illustrated in FIG. 1A. In particular, cut-out portion 14 illustrates retroreflective elements 16 that have been applied in a pattern to the fabric 12. The retroreflective elements 16 can include microspheres. The retroreflective elements 16 can be applied onto the fabric 12 using any pattern and the pattern shown in FIG. 1B is merely an illustrative pattern. In general, the retroreflective elements 16 cover enough of the flame resistant fabric so that a silhouette of the garment 10 appears upon retroreflection of incident light. Typically, the retroreflective elements 16 cover at least about 5 percent of the outer surface of the flame resistant fabric 12. Preferably, the retroreflective elements 16 cover about 5 percent to about 40 percent of the outer surface of the flame resistant fabric 12. The retroreflective elements 16 most preferably cover about 10 percent to about 30 percent of the outer surface of the flame resistant fabric 12.

FIG. 1C is an exploded top-view of a cut-out portion 17 of the retroreflective elements 16 shown in FIG. 1B. Cut-out portion 17 illustrates microspheres 18 that have been applied to the surface of the fabric 12. The area of the fabric 12 that does not comprise microspheres 18 is coated with a binder 20 that attaches the microsphere to the fabric 12. Generally, the microspheres 18 are embedded in the binder 20 at a depth sufficient to retain the microspheres 18.

Figure 1D:
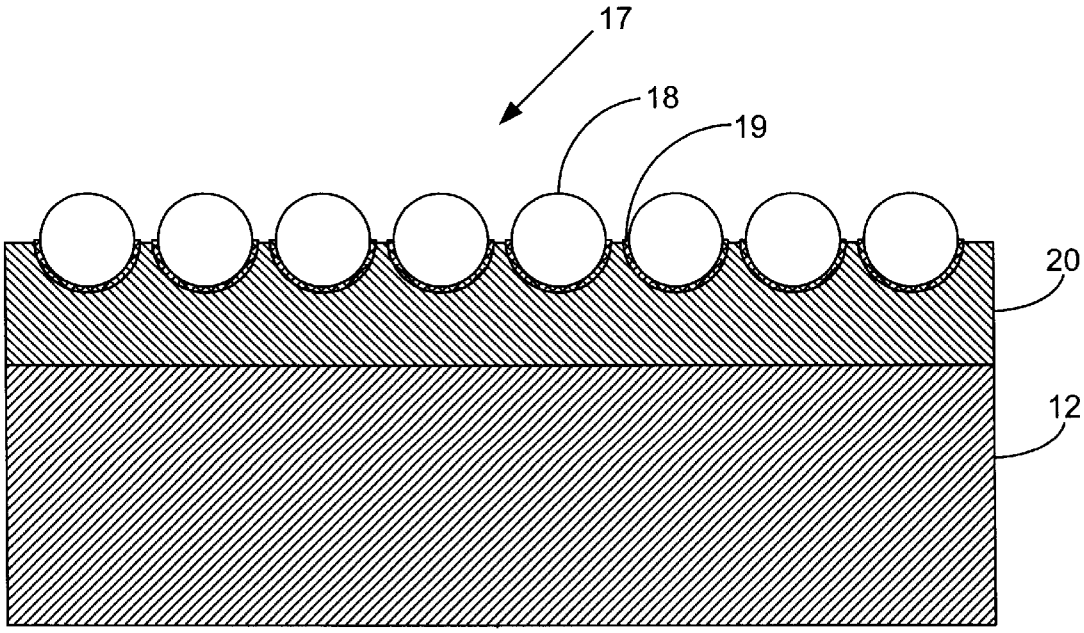
FIG. 1D is an exploded side-view of the fabric shown in FIG. 1C.

FIG. 1D illustrates an exploded side-view of cut-out portion 17 shown in FIG. 1C. The microspheres 18 are embedded in the binder 20, which is attached to the fabric 12. The microspheres 18 are hemispherically coated on the exterior with a specular reflective coating 19. The binder 20 includes compositions such as, for example, ink, paste, thermoplastic, plastic films, and other compositions capable of functioning to bond to the flame resistant fabric 12 and capable of retaining the microspheres 18. It should be noted that the specular reflective coating 19 may not always be oriented such that the specular reflective coating 19 is adjacent the binder 20. For example, some processes randomly apply coated microspheres 18 onto the binder 20, such that the specular reflective coating 19 is oriented in a manner that some microspheres 18 are not retroreflective. However, the cumulative effect of the other properly oriented, coated microspheres 18 is that the garment 10 is retroreflective.

The microspheres 18 are substantially spherical in shape to provide uniform and efficient retroreflection. Generally, the microspheres 18 are highly transparent to minimize light absorption so that a large percentage of incident light is retroreflected. The microspheres 18 often are substantially colorless but may be tinted or colored in some other fashion. The microspheres 18 may be made from glass, a non-vitreous ceramic composition, or a synthetic resin. In general, glass and ceramic microspheres 18 are preferred because they tend to be harder and more durable than microspheres 18 made from synthetic resins. Examples of microspheres 18 that may be used are disclosed in the following U.S. Pat. Nos: 1,175,224; 2,461,011; 2,726,161;

2,842,446; 2,853,393; 2,870,030; 2,939,797; 2,965,921; 2,992,122; 3,468,681; 3,946,130; 4,192,576; 4,367,919; 4,564,556; 4,758,469; 4,772,511; and 4,931,414. The disclosures of these patents are incorporated herein by reference. By way of example, the microspheres 18 have an average diameter of about 10 to 500 micrometers and have a refractive index of about 1.2 to 3.0.

The reflective specular coating 19 typically comprises a hemispheric metal or inorganic dielectric mirror reflective coating that is applied to the microspheres 18. The specular reflective coating 19 gives the microsphere 18 the characteristic of being able to collimate light so that incident light is returned in an opposite direction substantially along the same path along which the incident light originated. Generally, the hemispherical reflective coating 12 covers approximately one half of the surface area of the microsphere 18.

A variety of metals may be used to provide a specular reflective coating 19. These include elemental forms of aluminum, silver, chromium, nickel, magnesium, gold, and alloys thereof. Aluminum and silver are the preferred metals for use in the specular reflective coating 19 because they tend to provide the highest retroreflective brightness. The metal may be a continuous coating such as is produced by vacuum-deposition, vapor coating, chemical-deposition, or electroless plating. In this form, the specular reflective coating 19 normally comprises pure metal. It is to be understood that in some cases, such as for aluminum, some of the metal may be in the form of the metal oxide and/or hydroxide. The metal coating should be thick enough to reflect incoming light. Typically, the specular reflective coating 19 is about 50 to 150 nanometers thick.

Figure 1E:
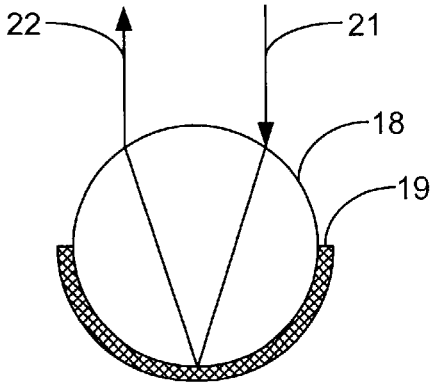
FIG. 1E is a side-view of one microsphere retroreflecting an incident beam of light.

FIG. 1E illustrates a microsphere 18 coated with a specular reflective coating 19. Generally, incident light 21 enters the microsphere 18 and is defracted by the microsphere 18. The incident light 21 is then reflected off of the specular reflective coating 19. Thereafter, the reflected light 22 exits the microsphere 18 after being defracted by the microsphere 18. The reflected light 22 travels in an opposite direction to the incident light 21, which gives the garment 10 retroreflective characteristics.

Flat screen printing, rotary screen printing, and transfer film techniques are used to apply the retroreflective elements 16 to flame resistant fabrics 12, although it will be understood that any technique that can apply the retroreflective material 19 to flame resistant fabrics 12 can be used. Typically, flat screen printing techniques involve placing a screen on top of the flame resistant fabric 12. A printing medium is poured upon the screen and a squeegee is moved back and forth within the confines of the screen. The squeegee forces the printing medium through the interstices of the screen and into contact with the flame resistant fabric 12. The screen is then lifted, the flame resistant fabric 12 is shifted relative to the frame so as to locate an untreated portion at the printing station, and the cycle is repeated. The printing medium may be a composition such as an ink or paste that includes microspheres 18. Alternatively, the microspheres 18 can be applied onto the printing medium after the printing medium has been applied to the flame resistant fabric 12.

Rotary screen printing refers to a printing process in which a perforated cylindrical screen is used to apply the printing medium onto a flame resistant fabric 12. The printing medium is pumped into the inner portion of the screen and forced out onto the flame resistant fabric 12 through the screen perforations. As the cylindrical screen rotates, the flame resistant fabric 12 moves and the printing medium is forced onto the flame resistant fabric 12. Numerous variables exist in rotary screen printing that may be altered to obtain the desired deposition of the printing medium. These variables include, for example, the speed at which the fabric is printed, the pressures used to force the printing medium through the screen, the screen type and mesh size, the viscosity of the printing medium, the percent of non-volatile substances within the printing medium, the drying temperature, and the length and type of dryer. As with flat screen printing, the printing medium may include the microspheres 18 or the microspheres can be applied onto the printing medium after the printing medium has been applied to the flame resistant fabric 12.

Retroreflective transfer film techniques include cascading a monolayer of microspheres 18 onto a carrier sheet. The microspheres 18 are releasably secured to the surface of the carrier sheet by applying heat and/or pressure. Next, a specularly reflective coating 19 is applied to the exposed surfaces of microspheres 18. The deposition on the exposed surface portion of the microspheres 18 to be covered with the specularly reflective coating 19 may be controlled in part by controlling the depth to which the microspheres 18 are embedded in the carrier sheet prior to application of the specular reflective coating 19. After the specular reflective coating 19 is applied to the microspheres 18, a binding material, such as, for example, an ink, polymer, or thermoplastic layer, is applied onto the mircrospheres 18 and carrier layer. Upon cooling, the binding material retains the microspheres 18 in the desired arrangement. Subsequently, the carrier sheet is heat-laminated to the flame resistant fabric 12. Applying heat and/or pressure to the carrier layer and flame resistant fabric 12 causes the microspheres 18 to adhere to the flame resistant fabric 12. The heat-lamination can be conducted so that a substantial portion the microspheres 18 are partially embedded into the flame resistant fabric 12. Thereafter, the carrier layer is striped away, such that a substantial majority, preferably substantially all, of the microspheres 18 are retained on the flame resistant fabric 12. In addition to the method described above, the binding material can be applied onto the flame resistant fabric 12 via the rotary screen technique. The heat and/or pressure can be used to transfer the microspheres 18 from the film to the surface of the flame resistant fabric 12 as opposed to applying the binding material onto the film.

For a further discussion of processes for applying microspheres 12 to fabrics, see U.S. Pat. Nos. 4,763,985; 5,128,804; and 5,200,262, the disclosures of which are incorporated herein by reference.

The garment 10 can be constructed once the retroreflective elements 16 have been applied to the flame resistant fabric 12. As discussed above, the garment 10 is constructed of flame resistant fabric 12, where the outer surface of the flame resistant fabric 12 has the retroreflective elements 16 applied thereon. The garment 10 is lightweight and can be single or double layered. The single layered garment is constructed of the flame resistant fabric 12. The double layered garment has an inner layer and an outer layer, where the outer layer is constructed of the flame resistant fabric 12. The inner layer can be constructed of any material known in the art and is typically disposed on the inside portion of the garment 10 in-between the body of the wearer and the outer layer. The inner layer and the outer layer can be attached in any manner known in the art. The weight of the flame resistant fabric 12 of the single or double layered garment 10 is less than about 10 ounces per square yard. Preferably, the weight of the flame resistant fabric 12 is less than about 7 ounces per square yard. More particularly, the weight of the flame resistant fabric 12 is less than about 5 ounces per square yard. The retroreflective elements 16 can be, for instance, purchased from Reflective Technology Industries, Ltd. (Cheshire, United Kingdom) or 3M Innovative Properties Company (St. Paul, Minn.).

Many variations and modifications may be made to the above-described embodiments of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A light-weight, single layered garment comprising:

a flame resistant fabric comprising an outer surface defined by a plurality of fibers upon which a composition including a plurality of retroreflective elements has been directly applied, the fibers comprising at least one of aramid fibers, polybenzimidazole fibers, polybenzoxazole fibers, melamine fibers, flame resistant rayon fibers, and flame resistant cotton fibers.

2. The garment of claim 1, wherein the flame resistant fabric is less than about 10 ounces per square yard.

3. The garment of claim 1, wherein the flame resistant fabric is less than about 7 ounces per square yard.

4. The garment of claim 1, wherein the flame resistant fabric is less than about 5 ounces per square yard.

5. A light-weight, single layered garment comprising:

a flame resistant fabric comprising an outer surface defined by a plurality of fibers, the fibers comprising at least one of aramid fibers, polybenzimidazole fibers, polybenzoxazole fibers, melamine fibers, flame resistant rayon fibers, and flame resistant cotton fibers, wherein substantially all of the fibers of the outer surface have a plurality of retroreflective elements directly applied thereto, and wherein the plurality of retroreflective elements are included in a retroreflective binder.

6. The garment of claim 5, wherein the retroreflective binder has been applied to the outer surface of the flame resistant fabric using a rotary screen printing technique.

7. The garment of claim 5, wherein the retroreflective binder has been applied to the outer surface of the flame resistant fabric using a flat screen printing technique.

8. The garment of claim 1, wherein the plurality of retroreflective elements have been transferred to the outer surface of the flame resistant fabric from a retroreflective transfer film using a transfer film technique.

9. The garment of clam 1, wherein the flame resistant fabric has a coefficient of retroreflection of about 10 to about 500 candelas per lux per square meter.

10. The garment of claim 1, wherein the flame resistant fabric has a coefficient of retroreflection of about 100 to about 300 candelas per lux per square meter.

11. The garment of claim 1, wherein the flame resistant fabric has a coefficient of retroreflection of about 150 to about 250 candelas per lux per square meter.

12. The garment of claim 1, wherein the plurality of retroreflective elements covers at least about 5 percent of the outer surface of the flame resistant fabric.

13. The garment of claim 1, wherein the plurality of retroreflective elements covers at least about 5 percent to about 40 percent of the outer surface of the flame resistant fabric.

14. The garment of claim 1, wherein the plurality of retroreflective elements covers at least about 10 percent to about 30 percent of the outer surface of the flame resistant fabric.

15. The garment of claim 1, wherein the garment is a shirt.

16. The garment of claim 1, wherein the garment is a coverall.

17. The garment of claim 1, wherein the garment comprises pants.

18. The garment of claim 1, wherein the garment is a jacket.

19. A light-weight, two layered garment, comprising:

an outer fabric layer that is constructed of a flame resistant fabric comprising an inner surface and an outer surface, the outer surface defined by a plurality of fibers, the fibers comprising at least one of aramid fibers, polybenzimidazole fibers, polybenzoxazole fibers, melamine fibers, flame resistant rayon fibers, and flame resistant cotton fibers, and wherein a composition including a plurality of retroreflective elements has been applied directly to the fibers of the outer surface; and an inner fabric layer disposed on the inner surface side of the outer fabric layer.

20. The garment of claim 19, wherein the outer fabric layer is less than about 10 ounces per square yard.

21. The garment of claim 19, wherein the outer fabric layer is less than about 7 ounces per square yard.

22. The garment of claim 19, wherein the outer fabric layer is less than about 5 ounces per square yard.

23. The garment of claim 19, wherein the plurality of retroreflective elements are included in a retroreflective binder.

24. The garment of claim 23, wherein the retroreflective binder has been applied to the outer surface of the flame resistant fabric using a rotary screen printing technique.

25. The garment of claim 23, wherein the retroreflective binder has been applied to the outer surface of the flame resistant fabric using a flat screen printing technique.

26. The garment of claim 19, wherein the plurality of retroreflective elements have been transferred to the outer surface of the flame resistant fabric from a retroreflective transfer film using a transfer film technique.

27. The garment of claim 19, wherein the flame resistant fabric has a coefficient of retroreflection of about 10 to about 500 candelas per lux per square meter.

28. The garment of claim 19, wherein the flame resistant fabric has a coefficient of retroreflection of about 100 to about 300 candelas per lux per square meter.

29. The garment of claim 19, wherein the flame resistant fabric has a coefficient of retroreflection of about 150 to about 250 candelas per lux per square meter.

30. The garment of claim 19, wherein the plurality of retroreflective elements covers at least about 5 percent of the outer surface of the flame resistant fabric.

31. The garment of claim 19, wherein the plurality of retroreflective elements covers at least about 5 percent to about 40 percent of the outer surface of the flame resistant fabric.

32. The garment of claim 19, wherein the plurality of retroreflective elements covers at least about 10 percent to about 30 percent of the outer surface of the flame resistant fabric.

33. The garment of claim 19, wherein the garment is a shirt.

34. The garment of claim 19, wherein the garment is a coverall.

35. The garment of claim 19, wherein the garment comprises pants.

36. The garment of claim 19, wherein the garment is a jacket.

37. A method of constructing a retroreflective garment that is light-weight and has a single layer, comprising the steps of:

providing a flame resistant fabric that has an inner surface and an outer surface, the outer surface defined by a plurality of fibers, the fibers comprising at least one of aramid fibers, polybenzimidazole fibers, polybenzoxazole fibers, melamine fibers, flame resistant rayon fibers, and flame resistant cotton fibers;

providing a plurality of retroreflective elements; and applying to the fibers of the outer surface of the flame resistant fabric a composition including the plurality of retroreflective elements.

38. The method of claim 37, further comprising the step of constructing a light-weight, single layered, retroreflective garment from the flame resistant fabric so that the outer surface that has the plurality of retroreflective elements applied thereon faces away from the body of the wearer.

39. The method of claim 38, wherein the flame resistant fabric is less than about 10 ounces per square yard.

40. The method of claim 38, wherein the flame resistant fabric is less than about 7 ounces per square yard.

41. The method at claim 38, wherein the flame resistant fabric is less than about 5 ounces per square yard.

42. The method of claim 38, wherein the light-weight, single layered, retroreflective garment is a shirt.

43. The method of claim 38, wherein the light-weight, single layered, retroreflective garment is a coverall.

44. The method of claim 38, wherein the light-weight, single layered, retroreflective garment comprises pants.

45. The method of claim 38, wherein the light-weight, single layered, retroreflective garment is a jacket.

46. The method of claim 37, wherein the step of applying the outer surface of the flame resistant fabric with the plurality of retroreflective elements includes applying retroreflective binder to the outer surface of the flame resistant fabric with a rotary screen printing technology.

47. The method of claim 37, wherein the step of applying the outer surface of the flame resistant fabric with the plurality of retroreflective elements includes applying retroreflective binder to the outer surface of the flame resistant fabric with a flat screen printing technology.

48. The method of claim 37, wherein the step of applying the outer surface of the flame resistant fabric with the plurality of retroreflective elements includes applying the plurality of retroreflective elements to the outer surface of the flame resistant fabric with a transfer film technology.

49. A method of constructing a retroreflective garment that is light-weight and has two layers, comprising the steps of:

providing an inner fabric layer and an outer fabric layer, the outer fabric layer comprising a flame resistant fabric that has an inner surface and an outer surface, the outer surface defined by a plurality of fibers, the fibers comprising at least one of aramid fibers, polybenzimidazole fibers, polybenzoxazole fibers, melamine fibers, flame resistant rayon fibers, and flame resistant cotton fibers;

providing a plurality of retroreflective elements; and applying to the fibers of the outer surface of the flame resistant fabric a composition including the plurality of retroreflective elements.

50. The method of claim 49, further comprising the step of constructing a light-weight, two layered, retroreflective garment from the inner fabric layer and the outer fabric layer so that the outer surface of the outer fabric layer that has the plurality of retroreflective elements applied thereon faces away from the body of the wearer and the inner fabric layer is disposed in-between the outer fabric layer and the body of the wearer.

51. The method of claim 50, wherein the outer fabric layer is less than about 10 ounces per square yard.

52. The method of claim 50, wherein the outer fabric layer is less than about 7 ounces per square yard.

53. The method of claim 50, wherein outer fabric layer is less than about 5 ounces per square yard.

54. The method of claim 50, wherein the light-weight, two layered, retroreflective garment is a coverall.

55. The method of claim 50, wherein the light-weight, two layered, retroreflective garment comprises pants.

56. The method of claim 50, wherein the light-weight, two layered, retroreflective garment is a jacket.

57. The method of claim 49, wherein the step of applying the outer surface of the flame resistant fabric with the plurality of retroreflective elements includes applying retroreflective binder to the outer surface of the flame resistant fabric with a rotary screen printing technology.

58. The method of claim 49, wherein the step of applying the outer surface of the flame resistant fabric with the plurality of retroreflective elements includes applying retroreflective binder to the outer surface of the flame resistant fabric with a flat screen printing technology.

59. The method of claim 49, wherein the step of applying the outer surface of the flame resistant fabric with the plurality of retroreflective elements includes applying the plurality of retroreflective elements to the outer surface of the flame resistant fabric with a transfer film technology.

60. A light-weight, single layered garment comprising:

a flame resistant fabric comprising an outer surface defined by a plurality of fibers, the fibers comprising at least one of aramid fibers, polybenzimidazole fibers, polybenzoxazole fibers, melamine fibers, flame resistant rayon fibers, and flame resistant cotton fibers;

a binder coating the fibers of the fabric; and retroreflective microspheres embedded in the binder.

61. A light-weight, single layered garment comprising:

a flame resistant fabric comprising an outer surface defined by a plurality of fibers, the fibers comprising at least one of aramid fibers, polybenzimidazole fibers, polybenzoxazole fibers, melamine fibers, flame resistant rayon fibers, and fine resistant cotton fibers, wherein substantially all of the fibers of the outer surface are coated with a binder; and retroreflective microspheres embedded in the binder.

62. A light-weight, two layered garment, comprising:

an outer fabric layer that is constructed of a flame resistant fabric comprising an inner surface, and an outer surface, the outer surface defined by a plurality of fibers, the fibers comprising at least one of aramid fibers, polybenzimidazole fibers, polybenzoxazole fibers, melamine fibers, flame resistant rayon fibers, and flame resistant cotton fibers, wherein a binder coats the fibers, and wherein retroreflective microspheres are embedded in the binder; and an inner fabric layer disposed on the inner surface side of the outer fabric layer.

63. A method of constructing a retroreflective garment that is light-weight, comprising the steps of:

applying the retroreflective elements to fibers of an outer surface of a flame resistant fabric via flat screen printing, the fibers comprising at least one of aramid fibers, polybenzimidazole fibers, polybenzoxazole fibers, melamine fibers, flame resistant rayon fibers, and flame resistant cotton fibers.

64. A method of constructing a retroreflective garment that is light-weight, comprising the steps of:

applying the retroreflective elements to fibers of an outer surface of a flame resistant fabric via rotary screen printing, the fibers comprising at least one of aramid fibers, polybenzimidazole fibers, polybenzoxazole fibers, melamine fibers, flame resistant rayon fibers, and flame resistant cotton fibers.

65. A method of constructing a retroreflective garment that is light-weight, comprising the steps of:

applying the retroreflective elements to fibers of an outer surface of a flame resistant fabric via transfer film techniques, the fibers comprising at least one of aramid fibers, polybenzimidazole fibers, polybenzoxazole fibers, melamine fibers, flame resistant rayon fibers, and flame resistant cotton fibers.

* * * * *